US006334301B1

(12) United States Patent
Otsap et al.

(10) Patent No.: US 6,334,301 B1
(45) Date of Patent: Jan. 1, 2002

(54) ASSEMBLY OF ETCHED SHEETS FORMING A FLUIDIC MODULE

(75) Inventors: Ben A. Otsap, Los Angeles; Joseph M. Cardin, Yorba Linda; Antonio Gonzalez, La Mirada; Keith Dyer, Fountain Valley, all of CA (US)

(73) Assignee: Vacco Industries, Inc., South El Monte, CA (US)

( * ) Notice: Subject to any disclaimer, the term of this patent is extended or adjusted under 35 U.S.C. 154(b) by 0 days.

(21) Appl. No.: 09/257,186

(22) Filed: Feb. 25, 1999

(51) Int. Cl.[7] ..... F02G 1/00

(52) U.S. Cl. ..... 60/200.1; 137/833; 165/167; 29/592.1

(58) Field of Search ..... 29/557, 602.1, 29/604, 606, 603.18, 592; 137/833, 803, 804, 805, 560; 216/56; 148/DIG. 51, 903; 60/200, 202, 203; 165/166, 167, 908

(56) References Cited

U.S. PATENT DOCUMENTS 3,731,700 A * 5/1973 Cohen ..... 137/833
5,027,596 A 7/1991 Steenborg
5,603,351 A * 2/1997 Cherukuri et al. ..... 137/597
5,681,484 A * 10/1997 Zanzucchi et al. ..... 216/2
6,673,785 * 10/1997 Schlaak et al. ..... 200/245
5,989,402 A * 11/1999 Chow et al. ..... 204/601
6,167,910 B1 * 1/2001 Chow ..... 137/827

FOREIGN PATENT DOCUMENTS

| | | |
|---|---|---|
| EP | 0845603 | 3/1998 |
| JP | 07726467 | * 8/1995 |
| WO | 9746820 | 11/1997 |
| WO | 9747013 | 11/1997 |

* cited by examiner

*Primary Examiner*—S. Thomas Hughes
*Assistant Examiner*—John C. Hong
(74) *Attorney, Agent, or Firm*—Pillsbury Winthrop LLP

(57) ABSTRACT

A modular subsystem of a fluidic system is formed by assembling a set of chemically etched sheets of material. The modular subsystem includes mechanical, electrical, and fluidic components. A plurality of sheet members is provided. Respective ones of the sheet members are etched to form portions of mechanical, electrical, and fluidic components. A set of the sheet members are attached to each other to form a modular subsystem comprising the mechanical, electrical, and fluidic components. The resulting modular subsystem is assembled from a set of chemically etched sheets of material, and comprises a set of sheet members attached to each other. Each sheet member within the set is etched so that the mechanical, electrical, and fluidic components are formed when the sheet members are attached to each other.

13 Claims, 4 Drawing Sheets

ASSEMBLY OF ETCHED SHEETS FORMING A FLUIDIC MODULE

BACKGROUND OF THE INVENTION

1. Field of the Invention

The present invention relates to certain methods or systems for forming and assembling subsystems for use in fluidic systems, and to the subsystems resulting from such formation and assembly.

2. Description of Background Information

Two main types of propulsion systems include chemical propulsion systems and electric propulsion systems. Some electric propulsion devices include the Xenon ion thruster (Kaufman Ion Bombardment), the Hall effect thruster, the arcjet, the pulsed plasma thruster, and the resistojet. Other electric propulsion devices include the magnetoplasma dynamic (MPD) thrusters, contact ion thrusters, and pulsed induction thrusters. Some chemical propulsion devices include cold gas devices which use cold gas propellants, such as nitrogen, argone, ammonia, or freon 14, and liquid propellant devices which use either a monopropellant or a bipropellant. Some common monopropellants include hydrazine ($N_2H_4$) and hydroperoxide ($H_2O_2$).

Chemical and electric propulsion systems incorporate subsystems (e.g., flow control, pressure transducers, etc.) each of which comprises fluidic, electrical, and mechanical structures. These subsystems typically comprise separately machined components assembled to form a given subsystem or module. Those components may comprise, e.g., one or more of low and high thrust engines, pressurant storage tanks, pressure regulators, isolation valves, filters, fill and vent valves, fill and drain valves, pressure transducers, temperature transducers, propulsion system electronics, and heaters. The components may also comprise electronic components such as driver circuits for engine valves, latching valves, solid state latches for thermal environment control heaters, signal conditioning circuitry, power converters, voltage regulators, and control logic.

There is a need for improved methods for forming assemblies of these different components in the form of integrated modules, and for such methods which facilitate the integrated assembly of modules, comprising various fluidic, electric, and mechanical components, at a low cost. The resulting modules also should be of a low weight, dependable in their operation, and take up a minimum amount of space. There is also a need for low flow-rate systems suitable for the very small flow rates required by electric propulsion systems. In addition, very small chemical and electric propulsion systems are required for many satellite and microsatellite applications.

SUMMARY OF THE INVENTION

In view of the above, the present invention, through one or more of its various aspects and/or embodiments, is thus presented to bring about one or more objects and advantages such as those noted below.

An object of the present invention is to provide a method for forming and assembling etched sheet layers to create a fluidic module (i.e., a module comprising fluidic components). Another object of the present invention is to form such an integrated module comprising mechanical, fluidic, and electrical components, all fabricated in one unified assembly or module, comprising multiple layers attached to each other.

A further object of the present invention includes providing a method for forming integrated modules serving as subsystems and propulsion systems, where such modules are of a reduced size, weight, power consumption, and cost. Such modules preferably will be robust, and made of dependable materials. The modules may comprise high precision components, such as flow resistors and filters utilized in propulsion systems.

The present invention, therefore, is directed to a method or system for forming and assembling etched sheets to create a fluidic modular subsystem, and to the modular subsystems resulting from such a method or system. More specifically, the present invention, in one aspect, is directed to a process for forming a modular subsystem of a fluidic system by assembling a set of chemically etched sheets of material. The modular subsystem comprises mechanical, electrical, and fluidic components. Plural sheet members are provided. Respective ones of the sheet members are etched to form portions of mechanical, electrical, and fluidic components. The sheet members forming a given set are attached to each other to form a modular subsystem comprising the mechanical, electrical, and fluidic components. The fluidic system may comprise a propulsion system.

In accordance with another aspect of the present invention, a modular subsystem of a fluidic system is provided, which is assembled from a set of chemically etched sheets of material. The modular subsystem comprises a set of sheet members attached to each other. Each sheet member within the set is etched so that the mechanical, electrical and fluidic components will be formed when the sheet members are attached to each other. The fluidic system may comprise a propulsion system.

BRIEF DESCRIPTION OF THE DRAWINGS

The present invention is further described in the detailed description which follows, by reference to the noted plurality of drawings, by way of non-limiting examples of embodiments of the present invention, in which like reference numerals represent similar parts throughout the several views of the drawings, and wherein.

DETAILED DESCRIPTION OF THE EXEMPLARY EMBODIMENTS

The specific embodiment illustrated is directed to a xenon flow control module, and to processes for forming one or more parts of that module. The illustrated flow control module is inexpensive to produce, low in mass, and small in size as compared to subsystems having the same functionality but formed utilizing separately machined components. The module is formed using a specific process which allows the utilization of a very sophisticated architecture without the associated increase in cost, mass, and/or size. An inlet filter is provided which helps protect the flow control module and downstream components against damage from contamination. A parallel redundant set of inlet isolation valves is provided to minimize the potential for long term propellant leakage. The illustrated flow control module may be controlled by simply using solenoid valve drivers, rather than the more complicated close-looped servo loops.

The flow rates may be incrementally adjusted by opening the valve corresponding with a desired flow resistor. If more than one valve is opened, the illustrated flow control module may incorporate a digital flow control approach, which allows the system to have a benign failure mode. Failure of one or more of the control valves to open will result in a degradation in engine performance, but not complete failure of the engine.

The design of the flow control module in the illustrated embodiment helps minimize contamination, as the valves have no sliding fits. Rather, when assembled they comprise only one part that flexes during operation. In addition, in order to reduce the risk of contamination damage, additional micron filters (e.g., five micron) may be located immediately downstream of each control valve seat.

Figure 1:
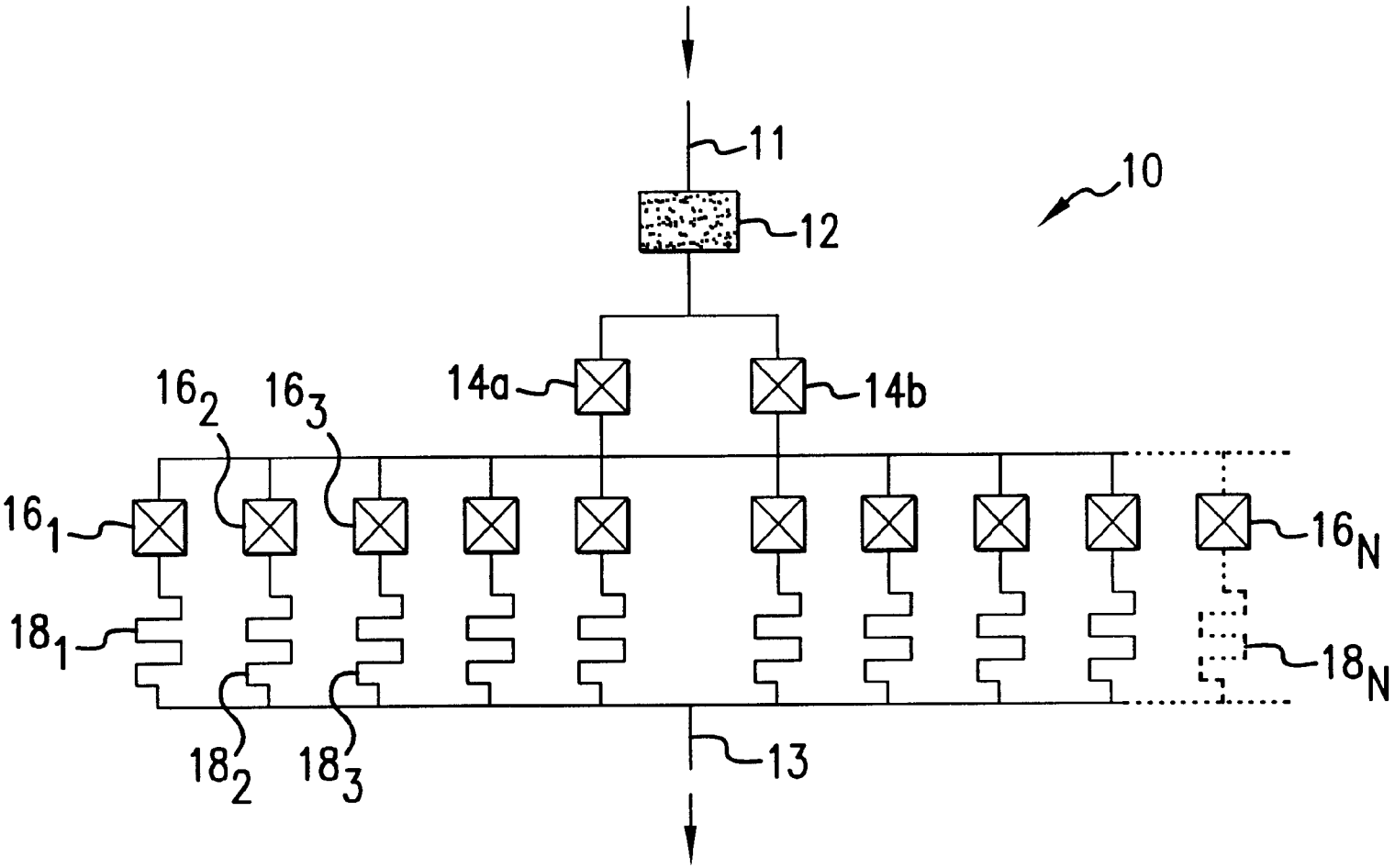
FIG. 1 is a schematic diagram of a flow control module for a propulsion system (e.g., a Hall effect or ion thruster system) in accordance with one embodiment.

Referring now to FIG. 1, an embodiment of flow control module 10 is illustrated. The illustrated flow control module 10 comprises an inlet 11, an inlet filter 12, and an outlet 13. Disposed between inlet filter 12 and outlet 13 is a set of components including an initial pair of redundancy (normally closed) isolation valves 14*a,* 14*b,* which are followed by a plurality of flow control valves connected in parallel. Normally closed flow control valves $\mathbf{16}_{1\text{-}N}$ are provided. Each control valve $\mathbf{16}_{1\text{-}N}$ is connected in series with an individual flow resistor $\mathbf{18}_{1\text{-}N}$ corresponding thereto. The number of flow control valves is set depending upon a number of design considerations and other factors affecting, e.g., how finely flow can be controlled by opening and closing different control valves.

FIGS. 2–5 illustrate the structure of the sheet members, and the manner in which they can be assembled to form the flow control module illustrated in FIG. 1.

Figure 4:
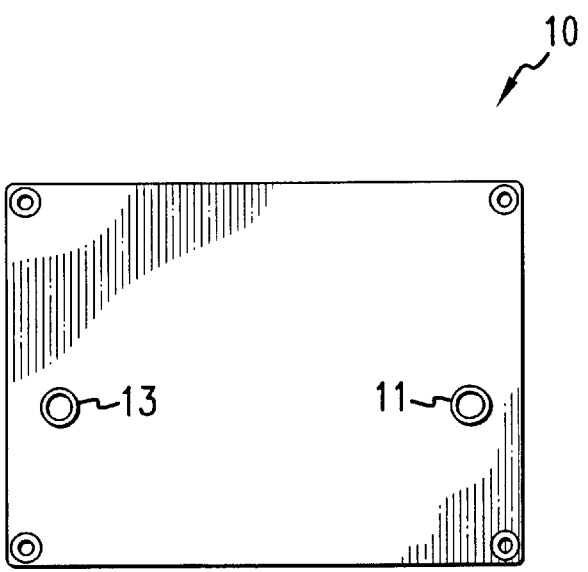
FIG. 4 is a bottom view of the flow control module.
Figure 3:
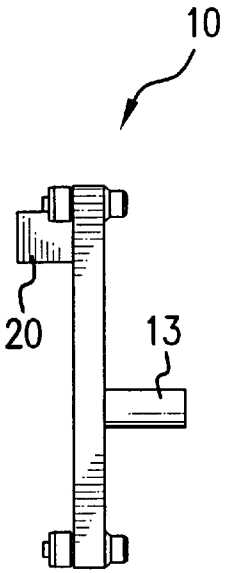
FIG. 3 is a sideview of the flow control module.
Figure 2:
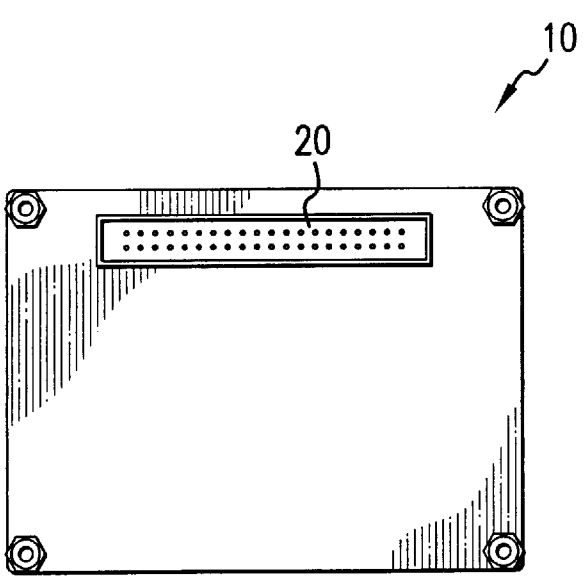
FIG. 2 is a top view of the flow control module.

FIGS. 2–4 show the illustrated flow control module in its completely assembled state, with FIG. 2 providing a top view, FIG. 3 providing a side view, and FIG. 4 providing a bottom view. As shown in FIG. 2, an electrical connector 20 is provided at the top of flow control module 10. On the back side of the illustrated flow control module 10 are provided inlet 11 and outlet 13.

Figure 5:
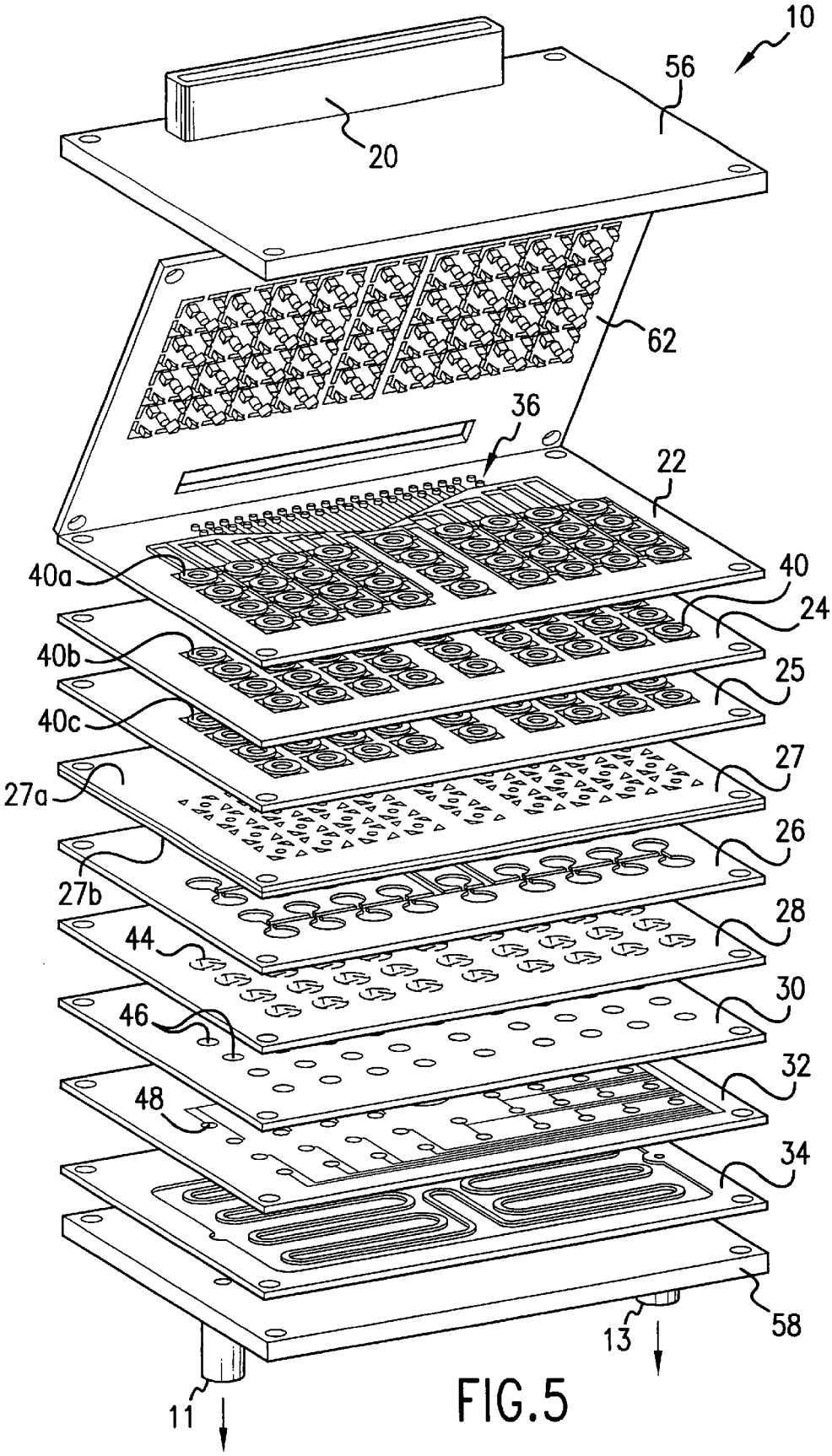
FIG. 5 is an overall exploded view of the illustrated flow control module.
Figure 6:
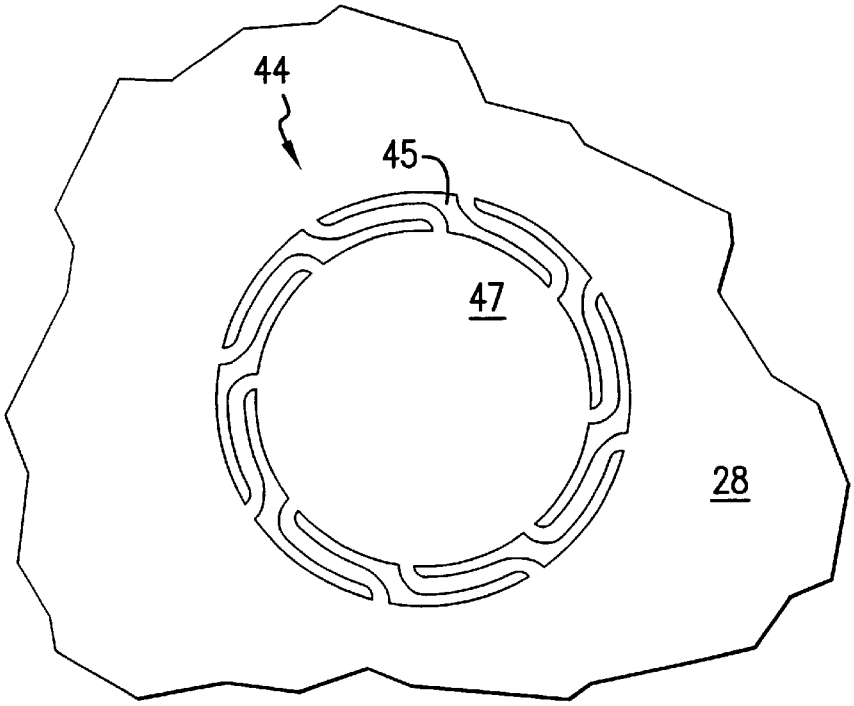
FIG. 6 is a partial view of the S-spring layer, and the seated layer.
Figure 7:
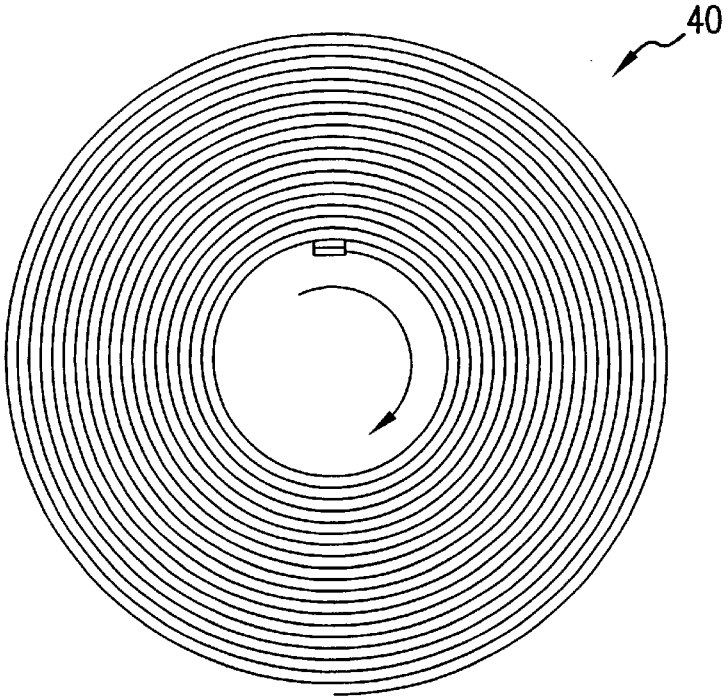
FIG. 7 is a top view of a coil-11.

FIG. 5 illustrates in an exploded view, various layers, which when assembled, form the illustrated flow control module 10. All of the illustrated layers are sandwiched between a top outer member 56 and a bottom outer member 58. The top outer member 56 carries an electrical connector 20, and bottom outer member 58 carries inlet 11 and outlet 13. The assembly comprises a top magnetically conductive layer 62, a coil lead layer 22, a plurality of coil layers 24, a coil return lead layer 25, a shunt layer 27, and S-spring layer 28, a seat layer 30, a valve outlet layer 32, and a filter layer 34.

Coil lead layer 22, coil layers 24, and coil return lead layer 25, when connected to each other, form a plurality of coils corresponding to the various valves of the flow control module. Magnetically conductive layer 62 comprises protrusions which extend outside and through the core portion of each coil formed by the coil layers, in order to maximize the force exerted by those coils when they are actuated. Shunt layer 27 provides opening passages through which the protrusions of the magnetically conductive layer 62 can extend, to make contact with the magnetically conductive part of the shunt layer, which is closer to the respective corresponding S-springs provided on S-spring layer 28. This allows the magnetic force exerted on the S-springs to be maximized, so that the sealing action performed by the S-springs in their default position will be overcome and the S-spring portions can be pulled away from the corresponding seat provided within seat layer 30, thereby opening the corresponding valve. A valve inlet layer (otherwise referred to as a feed plenum layer) 26 is provided between shunt layer 27 and S-spring layer 28. This layer serves to distribute fluid from inlet 11 to all of the N valves. It also creates a cavity for each S-spring to move, and serves as a mechanism for clamping down on the S-spring layer 28. It is noted that separate layers may be provided for distributing the fluid from the inlets to the valves, and both clamping and creating a space for the S-springs to move in, respectively.

Valve outlet layer 32 comprises a plurality of valve outlets 48, which serve as individual flow resistors through the flow control valve.

Coil lead layer 22 comprises a plurality of leads 36 which are coupled to respective winding contacts of upper winding portions 46*a*. Each of the upper winding portions 40*a* is coupled to a continuing winding portion of an intermediate coil layer 24.

A plurality of intermediate coil layers 24 are provided, in order to provide a predetermined number of windings for each coil. That is, each of the respective coil layers 24, when coupled to the other coil layers extends the coil, and accordingly extends the number of windings for each respective coil 40. The lower coil return lead layer 25 comprises lower coil portions which correspond to each of the coils, each of which is coupled to a return lead.

Shunt layer 27, in the illustrated embodiment, comprises an upper layer 27*a,* and a lower layer 27*b.* Upper layer 27*a* is not magnetically conductive, i.e., it does not have a material capable of carrying a sufficiently high flux density. In the illustrated embodiment, it comprises 316 L stainless steel, or may comprise a corrosion resistant steel or titanium. The lower layer is made of a ferromagnetic material that is capable of maintaining a high flux density, and in the illustrated embodiment comprises 430 F stainless steel or carbon steel.

Each of the corresponding portions of each layer is positioned in a certain position so that it will match up with the corresponding parts of the other layers. For example, coils 40 are positioned so that they will match up with upper coil portions and their coil portions, and the protruding portions of magnetic layer 62 are positioned so that they will pass through openings provided within the various coil layers and through the openings provided within shunt layer 27.

Shunt layer 27, by providing a lower magnetic layer 27*b,* helps increase the magnetic force that is exerted upon the S-springs 44, when a valve is opened by actuation of a corresponding coil 40. While the lower layer 27*b* of shunt layer 27 is comprised of a magnetic material, portions of it may be etched away, so as to maximize the flux air gap between the shunt layer and the S-springs.

Seat layer 30 comprises a matrix of seats 46 which correspond, in number and position, to coils 40, orifices 42, and S-springs 44.

The S-spring layer 28 is formed of a magnetically conductive material, i.e., a material which is capable of carrying a sufficiently high flux density. This allows each of the inner portions of each S-spring 44 to serve as an armature which is actuated by a respective coil, when that coil is energized. Alternatively, a separately formed disc-shaped armature, formed of a magnetic material, may be attached to the center portion of each S-spring 44, and S-spring layer 28 may be formed of a non-magnetic material. In the event individual disc-shaped armatures are provided, they would be preferably etched, so that the thickness of the armatures can be controlled to be uniform.

In the illustrated embodiment, S-springs 44 are preloaded and thus biased against the seat 46 provided at the side of seat layer 30 which is facing toward S-spring layer 28. This causes each of the seats within seat layer 30 to be sealed. When power is applied to the corresponding isolation valve coils 40, a magnetic flux is generated that attracts the center of the S-spring 46 toward its corresponding coil. This causes the S-spring 46 to be lifted off the seat, thereby allowing the Xenon (or other fluid) to flow across the seat. Xenon is discharged from both isolation valves into a common plenum valve inlet layer 26. In the illustrated embodiment, each of the layers, with the exception of the coil layers, is made of metal alloys. Alternatively, plastic materials may be utilized. In the illustrated embodiment, the bottom outer member 58 comprises stainless steel, corrosion resistant steel, or titanium. The next filter layer 34 may comprise stainless steel, corrosion resistant steel, aluminum, or titanium. Each of valve outlet layer 32 and seat layer 30 may also be made of either stainless steel, corrosion resistant steel, or titanium. As noted above, S-spring layer 28 is formed in this embodiment to be a magnetic conductive material. Accordingly, it may comprise 430 or 430FR stainless steel or carbon steel. Valve inlet layer 26 may comprise, for example, stainless steel, corrosion resistant steel, or titanium. As noted above, the non-magnetic upper layer 27*a* of shunt layer 27 may comprise, for example, 316 L stainless steel, corrosion resistant steel, or titanium. The lower magnetic layer 27*b* may comprise, for example, 430 F stainless steel or carbon steel.

Each of the winding coil layers, 22, 24 and 25 is formed with a substrate made of an insulative material, such as Kapton™ or fiberglass board. Copper or other conductors are formed thereon in order to form the winding.

Magnetic layer 62 may comprise, for example, carbon steel, or corrosion resistant steels such as 430 F or 430 FR. Top outer member 56, comprises, in the illustrated embodiment, 316 L stainless steel, or it may comprise of corrosion resistant steel, titanium, or aluminum.

The layers may be etched by using a process called photochemical milling. The sheet of starting materials is covered by a photoresist. An image is projected on it, and certain places of the photoresist once affected by light will change the solubility of the photoresist during layer treatments. Accordingly, a pattern is produced which can be etched (dissolved) to produce certain recesses and apertures. One etchent that is useful for a wide range of metals and alloys includes ferric chloride solution. Other materials can be dissolved in acid or base solutions as well.

In operation, fluid enters module 10 through inlet 11 and is discharged into the input side of inlet filter 12, which in the illustrated embodiment, is implemented by means of filter layer 34, when flow control module 10 is assembled, as shown in FIGS. 2–4. In the illustrated embodiment, the filter element comprises a serpentine arrangement of filter passages. Filtered Xenon is collected in the center of filter layer 34 and exits through a hole in the adjoining valve outlet layer 32. The Xenon is routed to valve inlet layer 26, where it flows into the two isolation valve cavities. Xenon then flows through the slots in the S-spring layer to the isolation valve seats provided within seat layer 30.

The S-springs are preloaded and thus biased against the raised seats provided at the side of seat layer 30 which is facing toward S-spring layer 28. This causes each of the seats within seat layer 30 to be sealed. When power is applied to the respective isolation valve coils within coil layer 24, a magnetic flux is generated that attracts the center of the Spring toward its corresponding coil. This causes the S-spring to be lifted off the seat, thereby allowing the Xenon to flow across the seat. Xenon is discharged from both isolation valves into a common plenum.

Xenon is discharged from valve outlet layer 32 and flows through two parallel paths, through the valve seat within seat layer 30 and S-spring layer 28, to the control valve feed plenums of valve inlet layer 26. Passages etched in valve inlet layer 26 route the Xenon to all the N control valves. An external controller (not shown) may be provided which applies power to one or more of the control valve coils to open them in order to meet the required flow rate. Flow across each control valve seat enters an individual discharge plenum in valve inlet layer 26. The Xenon in each discharge plenum flows through an individual flow resistor passage before reaching a common discharge plenum. A hole in the discharge plenum allows the Xenon to pass through the filter layer and exit the module through outlet 13.

The various layers, once fully assembled, can be attached to each other by the use of diffusion bonding, electron beam welding, bonding using adhesives, and by mechanical binding, which may involve, for example, the use of a seal layer between various layers and fasteners.

The system disclosed herein uses materials traditionally known to be appropriate for propulsion systems. Accordingly, the resulting system will be rugged, and will withstand the challenges of the environment of the propulsion system. Some caution should be exercised regarding the types of material used in the event the flow control module will be used for a propulsion system which use potentially corrosive propellants, for example, hydrazine or $H_2O_4$.

Some of the advantages of the present invention, incorporating one or more of the features of the illustrated embodiment, include the robust all-metal mechanical mechanisms that can be incorporated. In addition, both metal-to-metal and soft valve seats are possible with a system such as that described herein. The module can be easily manufactured to a size appropriate for propellant flow requirements. Components may be manufactured simultaneously as the sheets are etched and assembled. Super precision components such as inlet filters and precision flow control devices are possible and can be incorporated integrally into the module.

While the invention has been described with reference to several noted embodiments, it is understood that the words which have been used herein are words of description, rather than words of limitation. Changes may be made, within the purview of the appended claims, without departing from the scope and the spirit of the invention in its aspects. Although the invention has been described herein in reference to particular means, materials, and/or embodiments, it is understood that the invention is not to be limited to the particulars disclosed herein, and that the invention extends to all appropriate equivalent structures, methods, and uses such as are within the scope of the appended claims.

What is claimed:

1. A process for forming a modular subsystem of a propulsion system by assembling a set of processed sheets of material, said modular subsystem comprising mechanical, electrical, electromagnetic, and fluidic components, said process comprising:

providing plural sheet members;

performing material removal processing on respective ones of said sheet members to form portions of mechanical, electrical, electromagnetic, and fluidic components; and attaching a set of said sheet members to each other to form a modular subsystem comprising said mechanical, electrical, electromagnetic, and fluidic components.

2. The method according to claim 1, wherein said sheets are formed by chemical etching.

3. The method according to claim 1, wherein said sheets are formed by mechanically machining sheet material.

4. The method according to claim 1, wherein said sheets are formed by laser cutting sheet material.

5. A modular subsystem of a propulsion system assembled from a set of processed sheets of material, said modular subsystem comprising:

a set of sheet members attached to each other, each said sheet member within said set of sheet members being processed by removing material so that mechanical, electrical, electromagnetic, and fluidic components are formed when said sheet members are attached to each other.

6. The modular subsystem according to claim 5, wherein said sheets are formed by chemical etching.

7. The modular subsystem according to claim 5, wherein said sheets are formed by mechanically machining sheet material.

8. The modular subsystem according to claim 5, wherein said sheets are formed by laser cutting sheet material.

9. The modular subsystem according to claim 5, wherein said modular subsystem comprises a xenon flow control module of an electric propulsion system.

10. A process for forming a modular subsystem of a propulsion system by assembling a set of processed sheets of material, said modular subsystem comprising mechanical, electrical, electromagnetic, and fluidic components, said process comprising:

providing plural sheet members;

performing material removal processing on respective ones of said sheet members to form portions of mechanical, electrical, electromagnetic, and fluidic components; and attaching a set of said sheet members to each other to form a modular subsystem comprising said mechanical, electrical, electromagnetic, and fluidic components, wherein said electrical and electromagnetic components are adapted for use in manipulating said mechanical components.

11. A modular subsystem of a propulsion system assembled from a set of processed sheets of material, said modular subsystem comprising:

a set of sheet members attached to each other, each said sheet member within said set of sheet members being processed by removing material so that mechanical, electrical, electromagnetic, and fluidic components are formed when said sheet members are attached to each other, and said electrical and electromagnetic components being configured to manipulate said mechanical components.

12. A modular subsystem of a propulsion system assembled from a set of processed sheets of material, said modular subsystem comprising:

a set of sheet members attached to each other, each said sheet member within said set of sheet members being processed by removing material so that mechanical, electrical, electromagnetic, and fluidic components are formed when said sheet members are attached to each other, and said mechanical components comprising a plurality of mechanical valves, wherein said valves are configured to be operated by said electrical and electromagnetic components.

13. A process for forming a modular subsystem of a propulsion system by assembling a set of processed sheets of material, said modular subsystem comprising mechanical, electrical, electromagnetic, and fluidic components, said process comprising:

providing plural sheet members;

performing material removal processing on respective ones of said sheet members to form portions of mechanical, electrical, electromagnetic, and fluidic components; and attaching a set of said sheet members to each other to form a modular subsystem comprising said mechanical, electrical, electromagnetic, and fluidic components, said mechanical components comprising a plurality of mechanical valves, wherein said valves are configured to be operated by said electrical and electromagnetic components.

* * * * *